US011415944B2

(12) United States Patent
Silvant

(10) Patent No.: US 11,415,944 B2
(45) Date of Patent: Aug. 16, 2022

(54) TIMEPIECE, IN PARTICULAR A POCKET WATCH, EQUIPPED WITH AT LEAST ONE COVER

(71) Applicant: Omega SA, Biel/Bienne (CH)

(72) Inventor: Olivier Silvant, Macolin (CH)

(73) Assignee: Omega SA, Biel/Bienne (CH)

( * ) Notice: Subject to any disclaimer, the term of this patent is extended or adjusted under 35 U.S.C. 154(b) by 211 days.

(21) Appl. No.: 16/848,980

(22) Filed: Apr. 15, 2020

(65) Prior Publication Data

US 2020/0393796 A1 Dec. 17, 2020

(30) Foreign Application Priority Data

Jun. 17, 2019 (EP) ..... 19180676

(51) Int. Cl.
*G04B 37/00* (2006.01)
*G04B 3/04* (2006.01)
*G04B 15/14* (2006.01)

(52) U.S. Cl.
CPC ..... *G04B 37/0041* (2013.01); *G04B 3/041* (2013.01); *G04B 3/046* (2013.01); *G04B 15/14* (2013.01); *G04B 37/0025* (2013.01)

(58) Field of Classification Search
CPC .... G04B 37/0041; G04B 3/041; G04B 3/046; G04B 15/14; G04B 37/0025; G04B 37/0016; G04B 37/05; G04B 37/081
(Continued)

(56) References Cited

U.S. PATENT DOCUMENTS 296,631 A 4/1884 Schuetz
415,669 A 11/1889 Gaul
(Continued)

FOREIGN PATENT DOCUMENTS

CH 689 338 A5 2/1999
CH 714 534 B1 6/2019
CN 2161941 Y 4/1994
CN 106468878 A 3/2017
EP 0 841 602 B1 8/1999
(Continued)

OTHER PUBLICATIONS

Combined Chinese Office Action and Search Report dated Apr. 27, 2021 in Chinese Patent Application No. 202010554976.9 (with English translation of Categories of Cited Documents), 6 pages.
(Continued)

*Primary Examiner* — Edwin A. Leon

(74) *Attorney, Agent, or Firm* — Oblon, McClelland, Maier & Neustadt, L.L.P.

(57) ABSTRACT

A timepiece including a device for opening a cover including a fixed pendant mounted inside a middle part and a movable pendant for sliding within the fixed pendant towards the center of the case, the movable pendant having a guide element for moving along an axial guide groove, then in a circumferential guide groove into which the axial guide groove opens out and which is delimited by a boundary, such that, when the movable pendant is pushed, this movable pendant can be firstly displaced axially, then pivoted by an angle defined by the place at which the guide element abuts against the boundary, the movable pendant having a helical groove which comes into contact with at least one pin arranged with a clearance between the movable pendant and the locking spring and which is axially displaced towards the locking spring when the movable pendant is pushed, then pivoted, such that the pin presses against the locking spring and releases the cover.

14 Claims, 14 Drawing Sheets

(58) Field of Classification Search
USPC ..... 368/308
See application file for complete search history.

(56) References Cited

U.S. PATENT DOCUMENTS

| | | | | |
|---|---|---|---|---|
| 3,817,026 | A * | 6/1974 | Lopez | G04B 37/0016 368/312 |
| 6,322,246 | B1 | 11/2001 | Leung | |
| 7,942,574 | B2 * | 5/2011 | Hozumi | G04B 3/043 368/308 |

FOREIGN PATENT DOCUMENTS

| | | | |
|---|---|---|---|
| EP | 2 309 349 | A1 | 4/2011 |
| EP | 3 588 199 | A1 | 1/2020 |
| JP | 7198870 | A | 8/1995 |
| TW | I571711 | B | 2/2017 |

OTHER PUBLICATIONS

European Search Report dated Feb. 7, 2020 in European Application 19180676.9 filed Jun. 17, 2019 (with English Translation of Categories of Cited Documents), 6 pages.
Combined Taiwanese Office Action and Search Report dated Jan. 29, 2021 in corresponding Taiwanese Patent Application No. 109112995 (with English Translation of Category of Cited Documents) 5 pages.

* cited by examiner 2a
18
1
8a
6a
10
12
36
54
64
76
22
78
22
52
O
16
14
6b
8b
2b

TIMEPIECE, IN PARTICULAR A POCKET WATCH, EQUIPPED WITH AT LEAST ONE COVER

CROSS-REFERENCE TO RELATED APPLICATION

This application claims priority to European Patent Application No. 19180676.9 filed on Jun. 17, 2019, the entire disclosure of which is hereby incorporated herein by reference.

TECHNICAL FIELD OF THE INVENTION

The present invention relates to a timepiece, in particular a pocket watch, equipped with at least one cover which conceals, for example, a dial over which moves a set of hands.

BACKGROUND OF THE INVENTION

Timepieces of the pocket watch type were the first timepieces to be used by people. These pocket watches conventionally comprise a watch case, inside which a horological movement is housed, which drives a set of hour and minute hands which move above a dial. The hour and minute hands are conventionally covered by a watch crystal. In order to protect the watch crystal from scratches and the risk of breaking, some of these pocket watches are equipped with a cover that can move between a closed position in which the cover covers the crystal, and an open position in which the cover reveals the dial and the hands to the owner. Pocket watches equipped with a top cover and with a bottom cover also exist. The top cover covers, for example, a first dial and a first set of hour and minute hands, which indicate the current time, and the bottom cover covers a second dial above which a second set of hour and minute hands moves and which indicate a second time zone that is different from that provided by the first set of hands. Alternatively, the second cover can cover a crystal protecting a decorative pattern, a family photograph or other element.

Numerous embodiments of a pocket watch have already been proposed. One of these pocket watches comprises two covers, respectively a top cover and a bottom cover, and is equipped with a pendant ring which, in the rest position, extends vertically in the plane of the face of the watch case. These covers are opened by tilting the pendant ring forwards or backwards from the plane of the face of the watch case, and the choice to open the top or bottom cover is made by the direction in which said pendant ring is tilted. For example, the tilting of the pendant ring forwards from the plane of the face of the watch case causes the top cover to open, whereas the tilting of the same pendant ring backwards from the plane of the face of the watch case causes the bottom cover to open.

For this purpose, the pocket watch comprises two springs which are arranged so as to open and hold closed the top and bottom covers respectively. Two pistons bear against the top of the free ends of the springs. The pendant ring comprises two cam paths which are arranged such that, when the pendant ring is tilted forwards or backwards, these cam paths alternately actuate one of the two pistons, the actuated piston pressing on the corresponding spring, thus unlocking the chosen cover.

As understood from the above, the mechanism for opening the covers of a pocket watch briefly described hereinabove is a very basic mechanism, the main drawback thereof residing in the fact that a simple tilting of the pendant ring forwards or backwards causes the corresponding cover to instantly open. The risk of accidentally opening either of these covers is thus very high, which can be acceptable for a low-cost pocket watch, but certainly not for a premium range pocket watch.

SUMMARY OF THE INVENTION

The purpose of the present invention is to overcome the aforementioned problems and more by providing a timepiece such as a pocket watch equipped with a device allowing the one or more covers of this pocket watch to be opened in a simple and secure manner, while making any accidental opening of these covers virtually impossible.

For this purpose, the present invention relates to a timepiece, in particular a pocket watch, comprising a case delimited by a middle part and at the centre of which a horological movement is housed, the timepiece further comprising, on at least one of the faces thereof, a cover covering a device for displaying a piece of information or a decorative pattern, the timepiece further comprising a device for opening the cover, this cover being held in the closed position by a locking spring, the opening device comprising a fixed pendant mounted inside the middle part of the timepiece, in addition to a movable pendant capable of sliding coaxially within the fixed pendant towards the centre of the case, the movable pendant being equipped with a guide element capable of moving along an axial guide grooveguide groove, then in a circumferential guide groove into which the axial guide groove opens out, the axial guide groove and the circumferential guide groove being made in an inside surface of the fixed pendant, the circumferential guide groove being provided with a boundary away from the place at which the axial guide groove opens out, such that, when the movable pendant is pushed towards the centre of the case, this movable pendant can be firstly displaced axially, then pivoted by an angle defined by the place at which the guide element abuts against the boundary which delimits the circumferential guide groove, the opening device further comprising at least one pin which extends axially towards the centre of the case and which is arranged with a clearance between the movable pendant and the locking spring, the movable pendant having, on the pin side, a helical groove, this helical groove coming into contact with the pin and causing the axial displacement thereof towards the locking spring when the movable pendant is pushed, then pivoted, such that the pin presses against the locking spring and releases the cover from the retaining force exerted thereon by the locking spring.

According to one specific embodiment of the invention, the angle between the place at which the axial guide groove opens out into the circumferential guide groove and the place at which the boundary delimits the circumferential guide groove is equal or substantially equal to 90°.

According to another specific embodiment of the invention, the opening device comprises a pendant pipe mounted such that it is fixed inside the middle part of the timepiece, coaxially inside the fixed pendant, the movable pendant being capable of sliding between the fixed pendant and the pendant pipe.

According to yet another specific embodiment of the invention, the opening device comprises a return spring disposed coaxially inside the movable pendant and bearing between the movable pendant and the pendant pipe.

According to yet another specific embodiment of the invention, the opening device further comprises a crown pipe arranged coaxially inside the movable pendant and on which the return spring is threaded, this crown pipe bearing against the pendant pipe.

According to yet another specific embodiment of the invention, the opening device comprises a maneuvering ring mounted on the movable pendant.

According to yet another specific embodiment of the invention, the opening device comprises a setting stem which is disposed coaxially inside the crown pipe and which is guided by the pendant pipe.

According to yet another specific embodiment of the invention, the opening device comprises a crown mounted such that it is fixed to the setting stem.

According to yet another specific embodiment of the invention, the timepiece comprises a first cover over a first face and a second cover over a second face, the first cover being held in the closed position by a first locking spring, whereas the second cover is held in the closed position by a second locking spring, the axial guide groove opens out into a first and into a second circumferential guide groove which extend on either side of this axial guide groove and which are both delimited by a boundary, such that, when the movable pendant is pushed towards the centre of the case, this movable pendant can first be displaced axially, then be pivoted to the left or to the right by an angle defined by the place at which the guide element abuts against the boundary that delimits the first or the second circumferential guide groove in which it is located, the opening device comprising a first and a second pin which extend axially towards the centre of the case and which are arranged with a clearance between the movable pendant and the first locking spring, respectively the second locking spring, the movable pendant having, on the side of the first and second pins, a first and a second helical groove, these first and second helical grooves being arranged such that, depending on the direction in which the movable pendant is pivoted after having been pushed, either the first helical groove comes into contact with the first pin, or the second helical groove comes into contact with the second pin and causes, depending on the case, the axial displacement of the first pin or of the second pin towards the first locking spring, or respectively the second locking spring, such that, either the first pin presses against the first locking spring and releases the first cover from the retaining force exerted thereon by the first locking spring, or the second pin presses against the second locking spring and releases the second cover from the retaining force exerted thereon by the second locking spring.

Thanks to these features, the present invention provides a timepiece, in particular a pocket watch, that is equipped, at least on one of the faces thereof, with a cover covering a device for displaying a piece of information, for example a time indication, or a decorative pattern, this timepiece further comprising a device that allows the cover to be easily opened while completely or almost completely preventing any risk of this cover from opening accidentally. For this purpose, the opening device combines a pin disposed between the movable pendant and the locking spring of the cover and capable of being axially displaced towards the centre of the case, with a guide element provided on the movable pendant and capable of being displaced along an axial guide groove, then in a circumferential guide groove into which the axial guide groove opens out, these two axial and circumferential guide grooves being made in the fixed pendant. Thus, the pin will only weigh down on the locking spring and cause the cover to be released when the guide element has reached the bottom of the circumferential guide groove. The opening of the cover is thus dependent on a prior manipulation of the movable pendant which the owner of the timepiece, in particular of the pocket watch, must firstly displace axially towards the centre of the timepiece, in particular of the pocket watch, then pivot. This is a manipulation which the owner of the timepiece, in particular of the pocket watch, will have no difficulty remembering and carrying out and which simultaneously makes it almost impossible for the cover to open accidentally.

BRIEF DESCRIPTION OF THE FIGURES

Other features and advantages of the present invention will be better understood upon reading the following detailed description of one example embodiment of a pocket watch forming the timepiece according to the invention, said example being provided for the purposes of illustration only and not intended to limit the scope of the invention, given with reference to the accompanying drawing, wherein.

DETAILED DESCRIPTION OF ONE EMBODIMENT OF THE INVENTION

Figure 1:
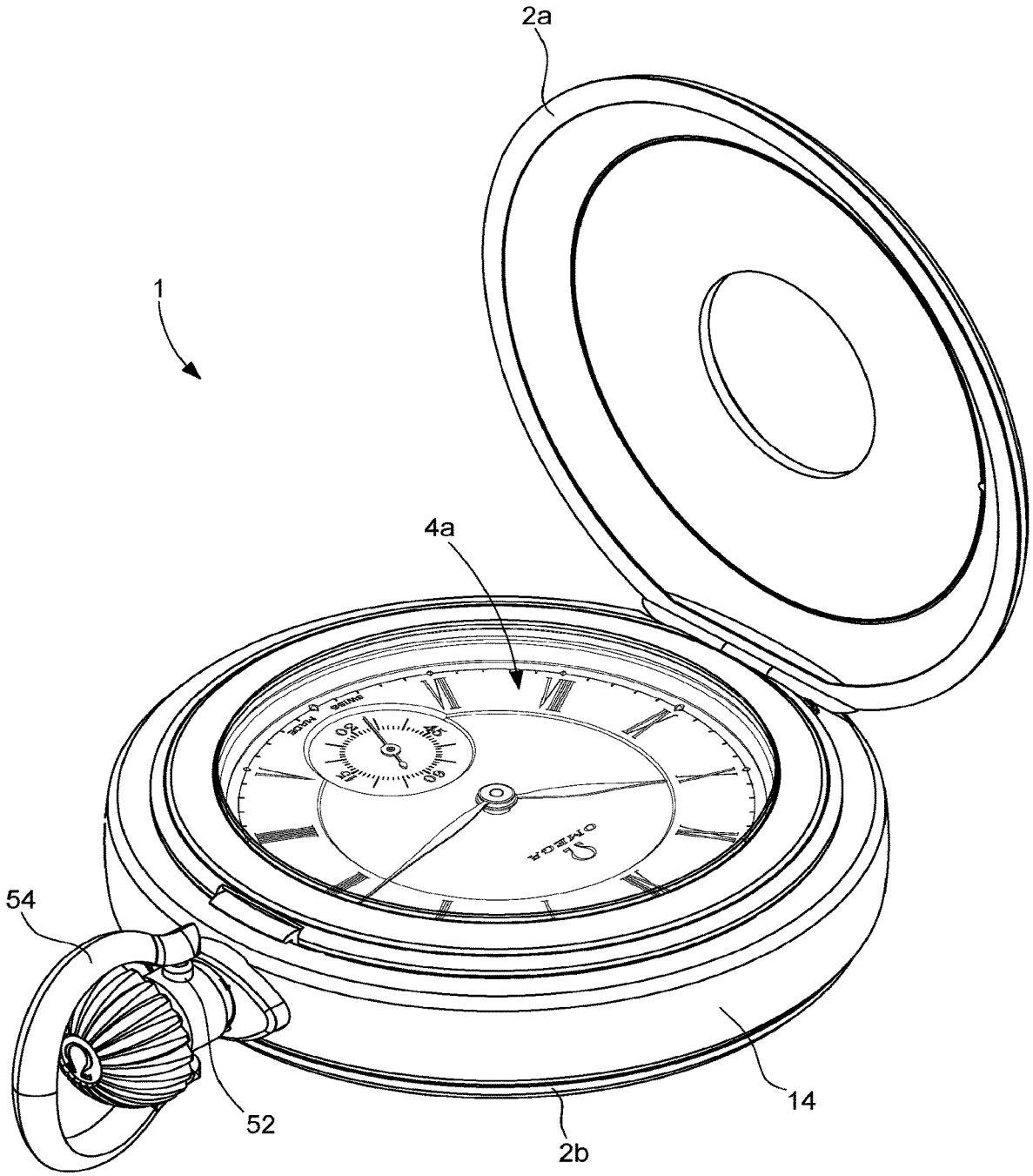
FIG. 1 is a perspective view of a pocket watch forming the timepiece according to the invention, the cover thereof covering the front face of this pocket watch being open.
Figure 2:
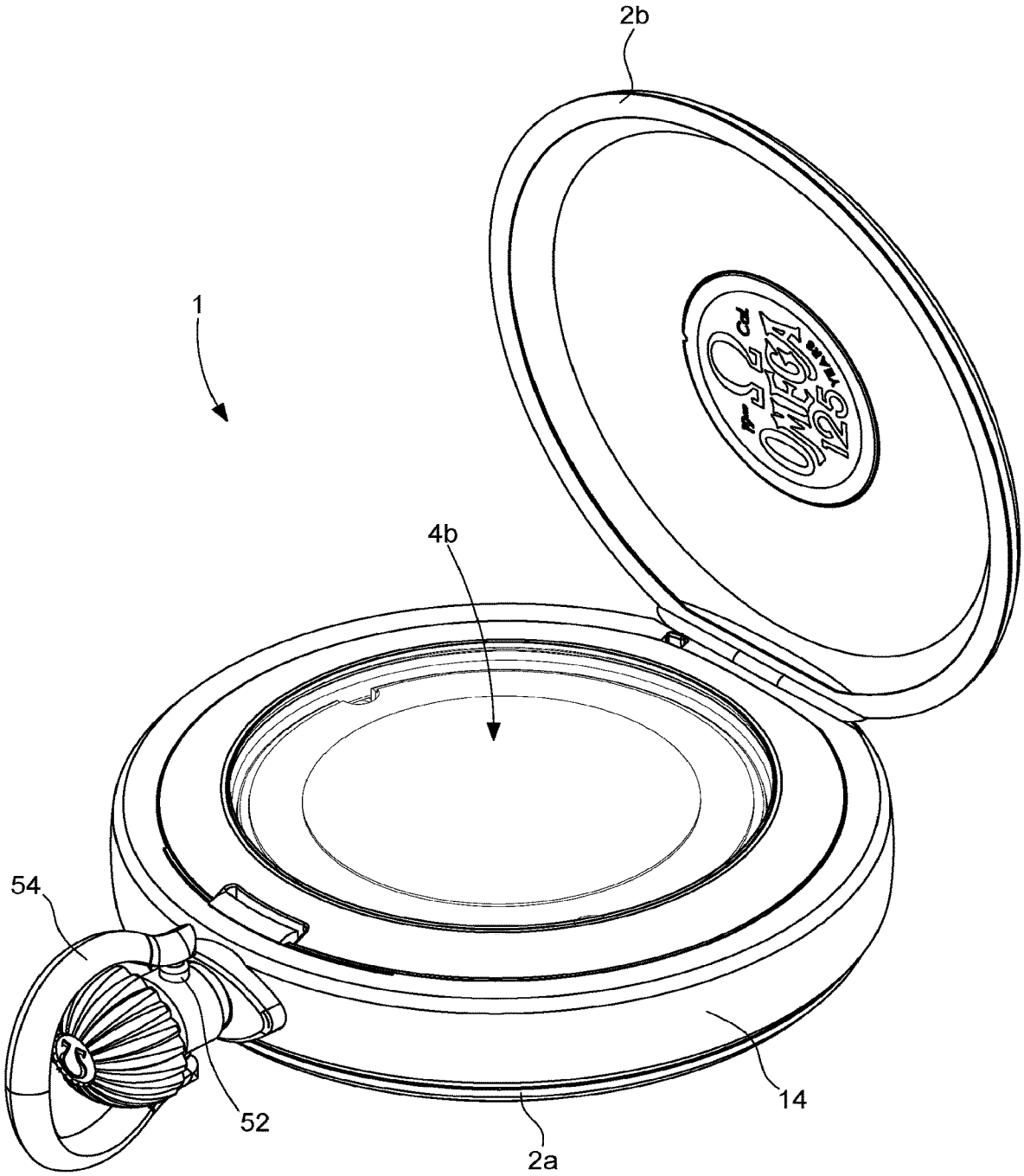
FIG. 2 is a perspective view of the pocket watch in FIG. 1, whereby the cover covering the rear face of this pocket watch is open.
Figure 3:
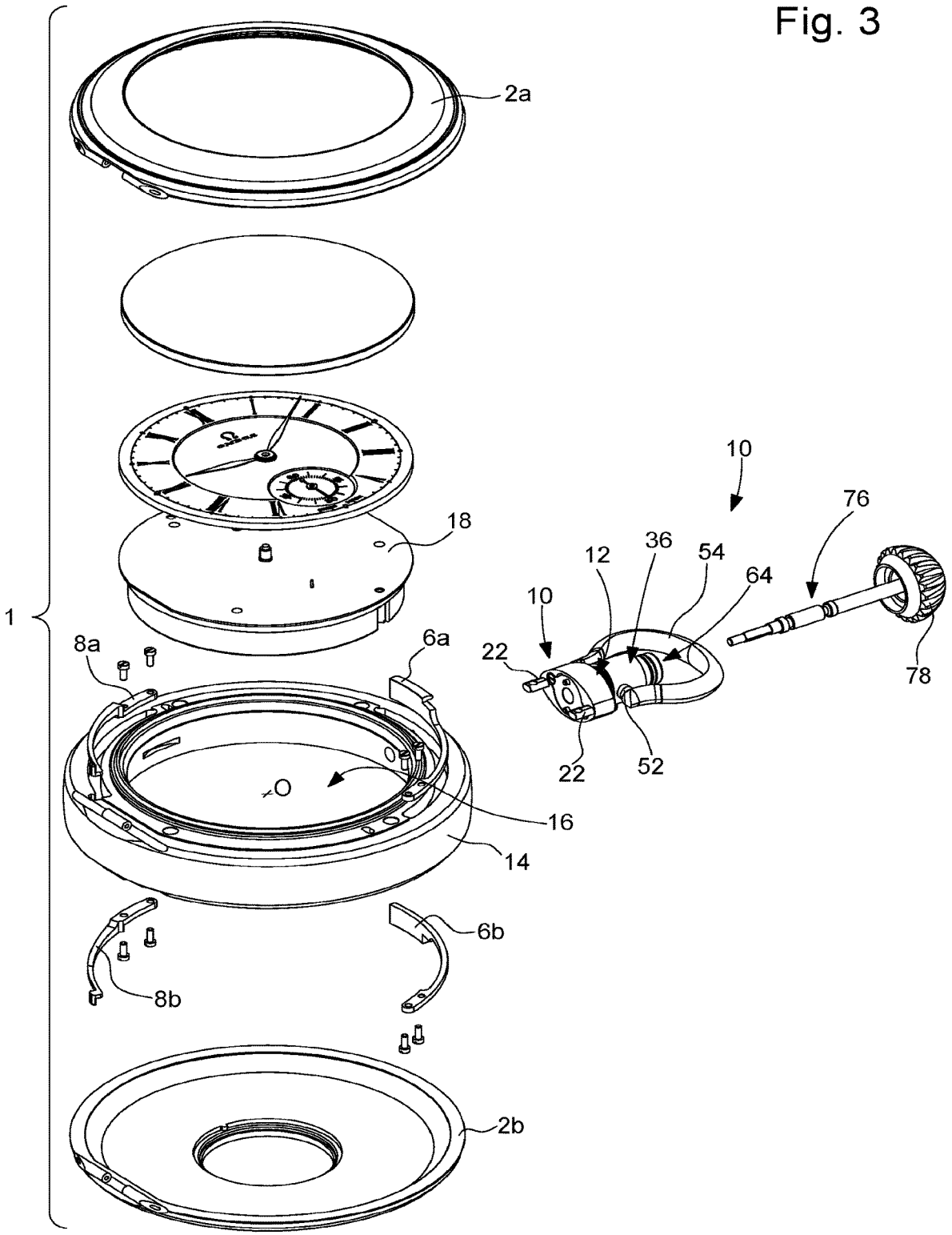
FIG. 3 is a perspective, exploded view of the pocket watch according to the invention.
Figure 4:
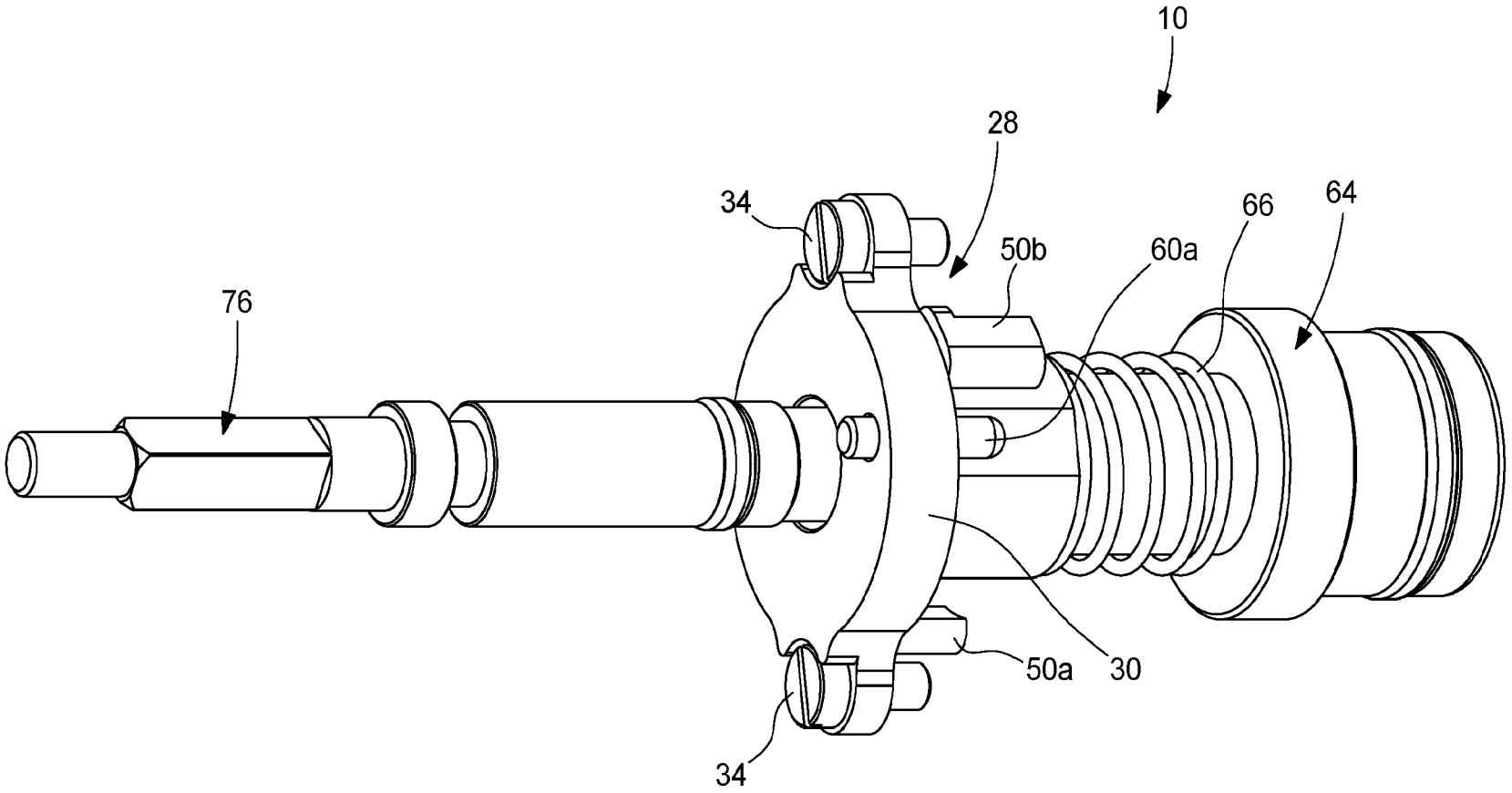
FIG. 4 is a perspective view of the device for opening the covers, the movable pendant having been omitted.
Figure 5:
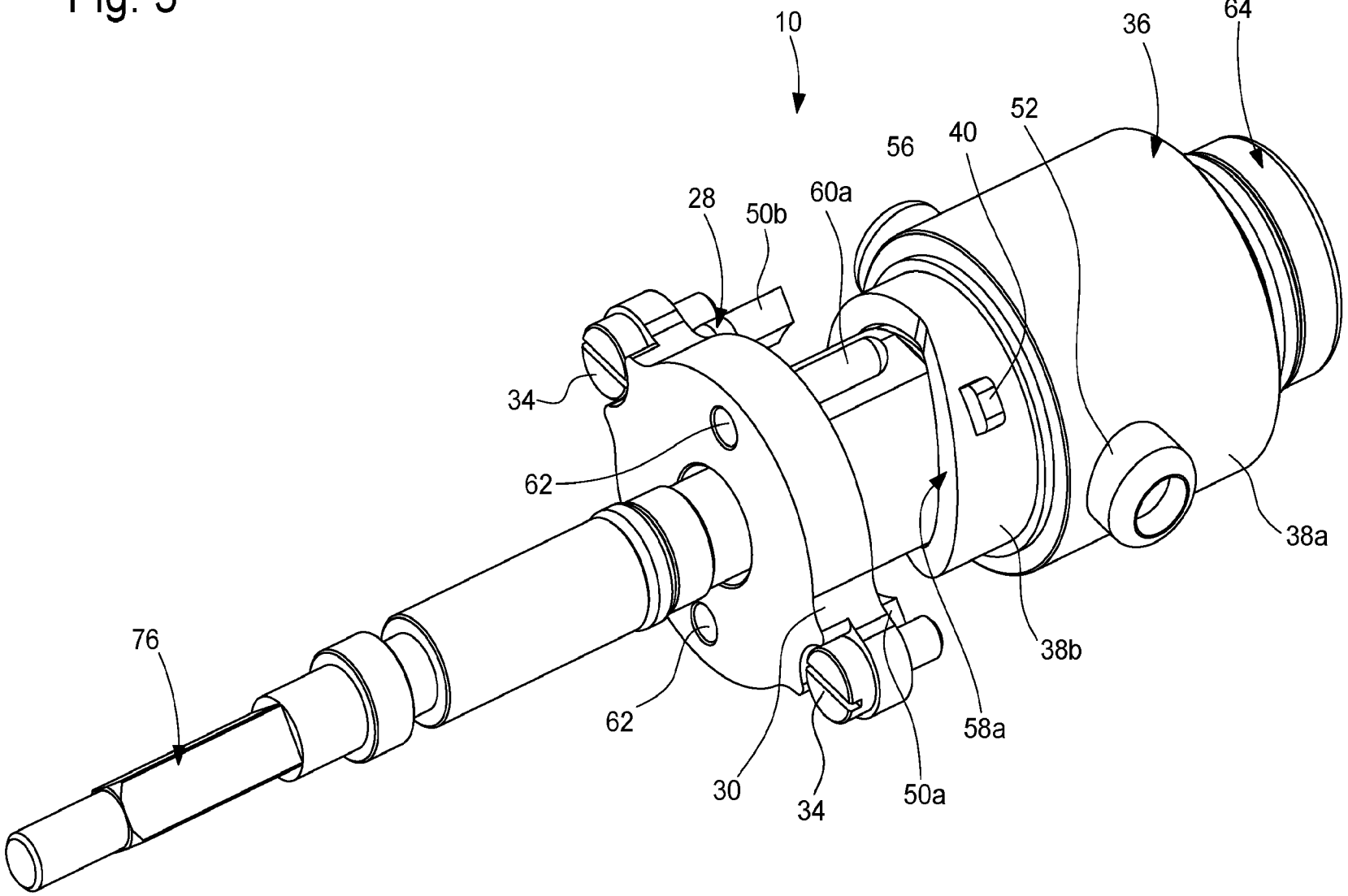
FIG. 5 is a similar view to that in FIG. 4, whereby the movable pendant is in position.
Figure 6:
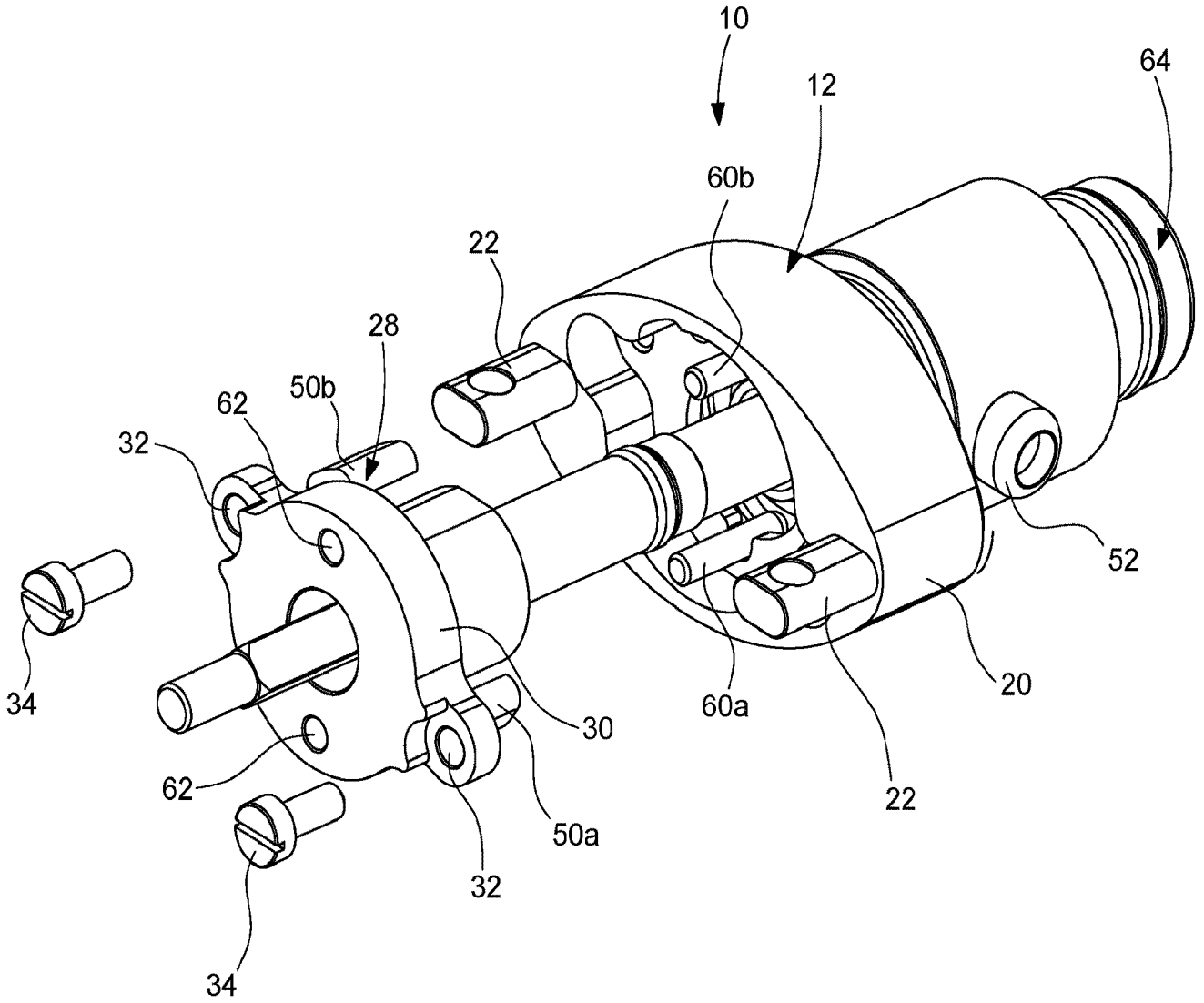
FIG. 6 is a perspective view of the opening device from an angle that allows the arrangement of the pins inside the fixed pendant to be viewed.
Figure 7A:
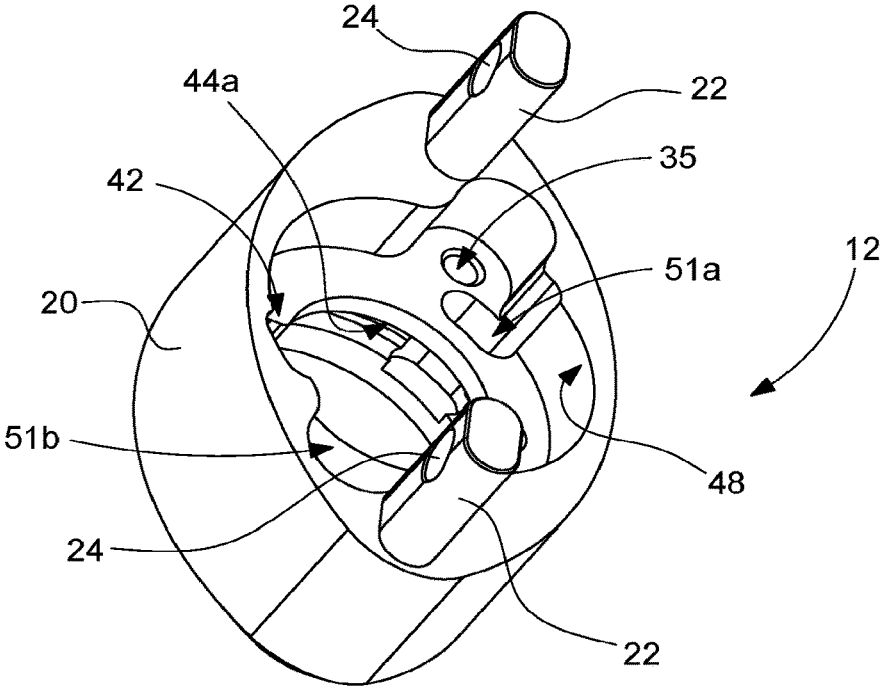
FIGS. 7A and 7B are perspective views respectively from above and from below of the fixed pendant in which the axial guide groove that opens out into the two circumferential guide grooves can be seen.
Figure 7B:
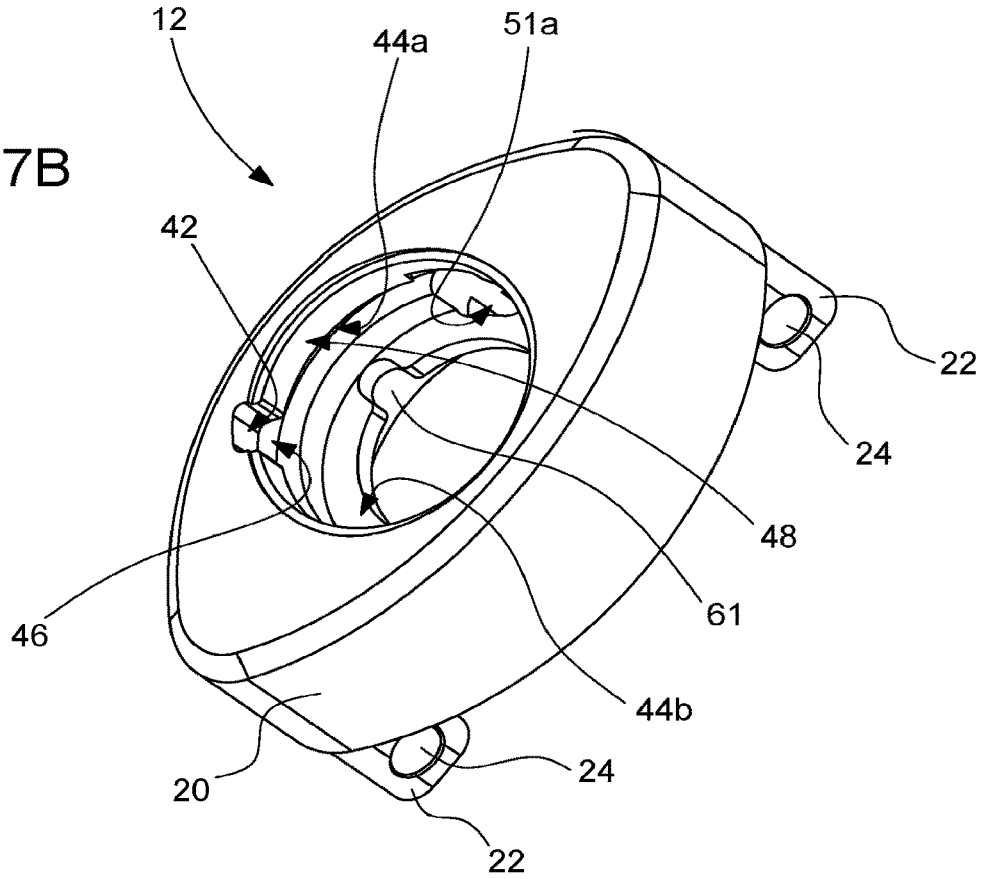
Figure 8:
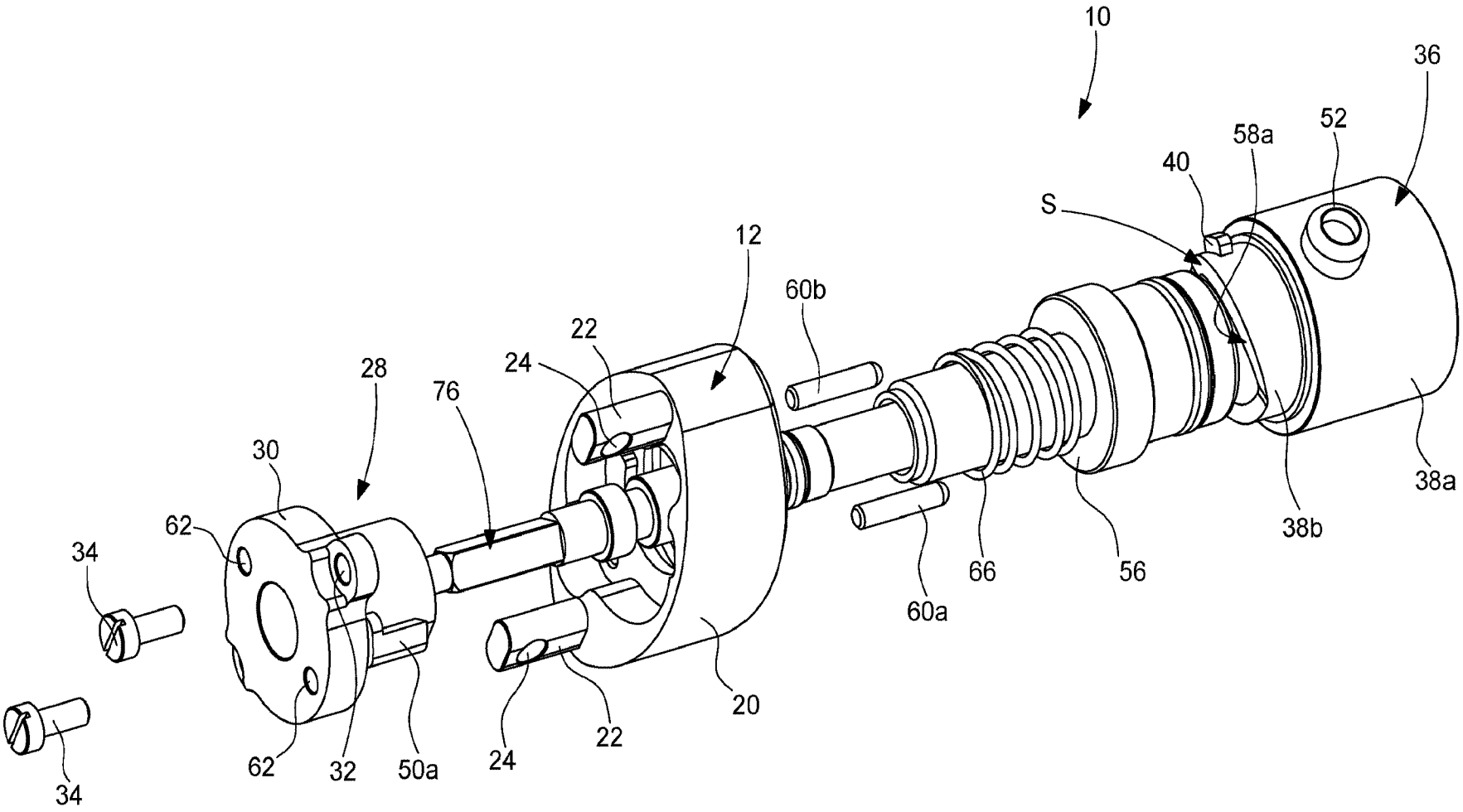
FIG. 8 is a perspective view in the partially separated state of the device for opening the covers.
Figure 9:
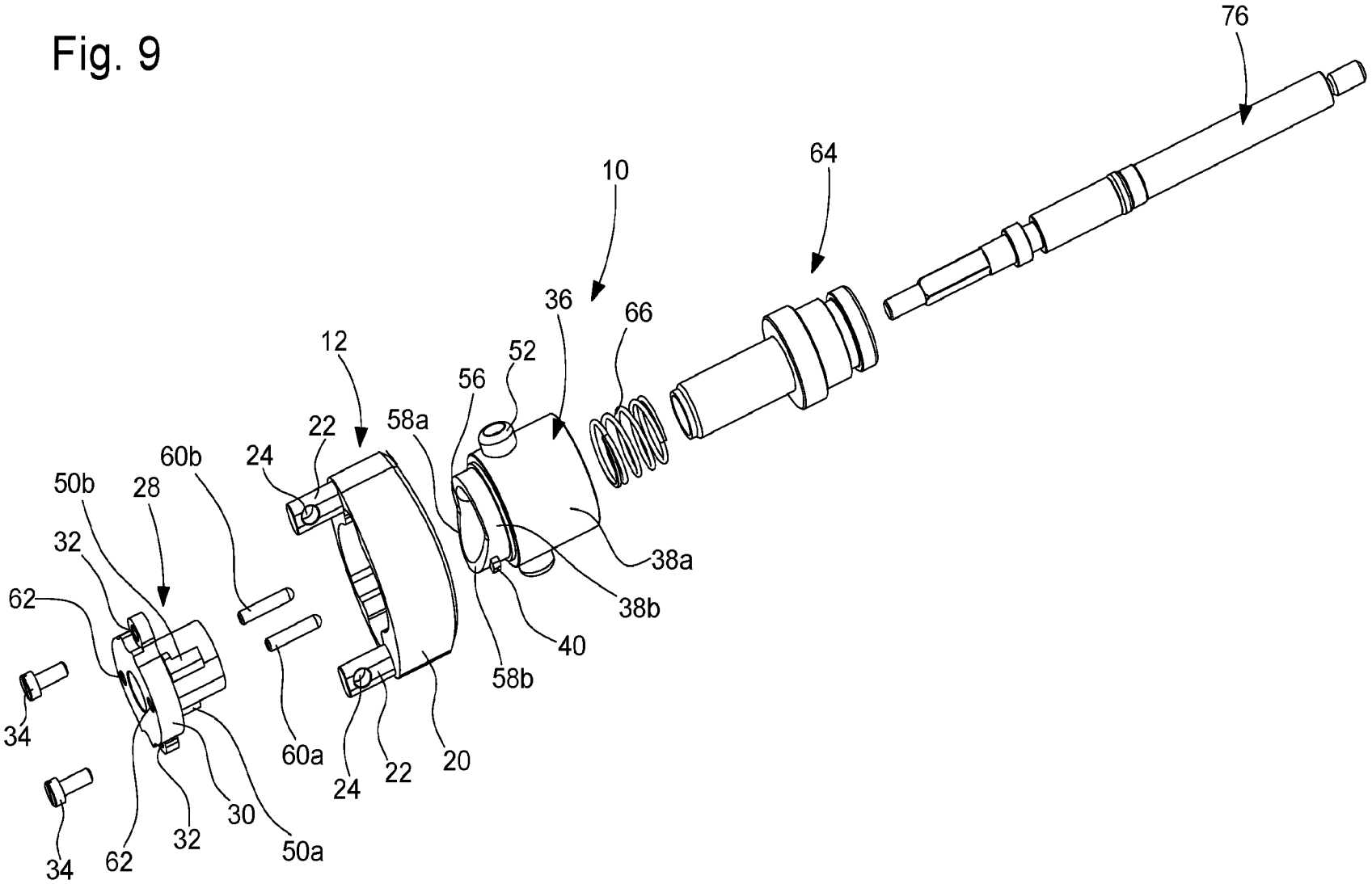
FIG. 9 is a perspective view in the separated state of the device for opening the covers, in which the crown pipe and the setting stem are in particular visible.
Figure 10:
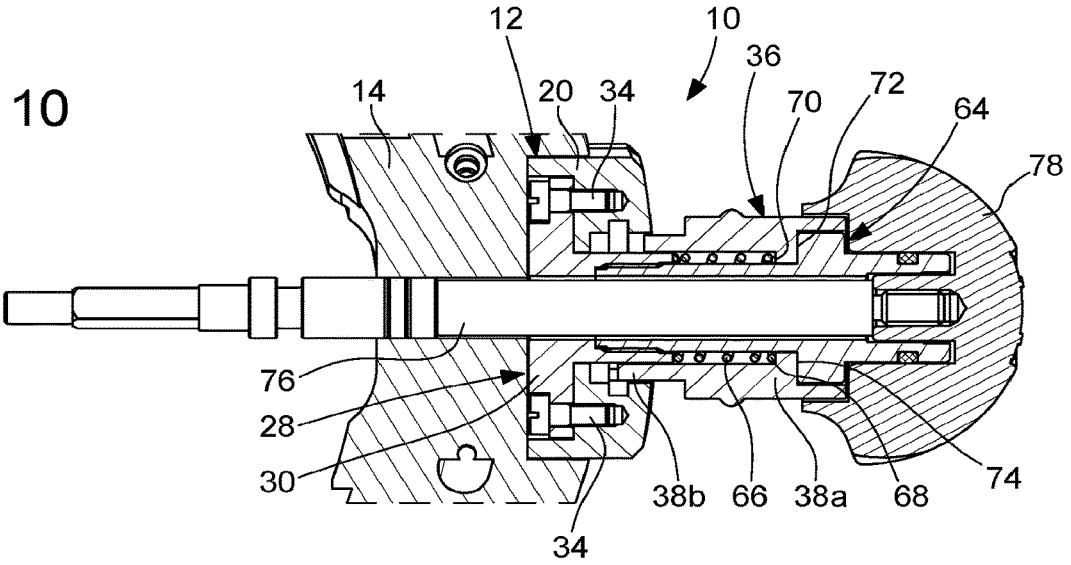
FIGS. 10, 11 and 12 are sectional views of the device for opening the covers in the rest position, the cutting plane respectively passing through the fastening screws of the pendant pipe (FIG. 10), through the actuating pins of the cover locking springs (FIG. 11), and through the actuating catch of the movable pendant (FIG. 12)
Figure 11:
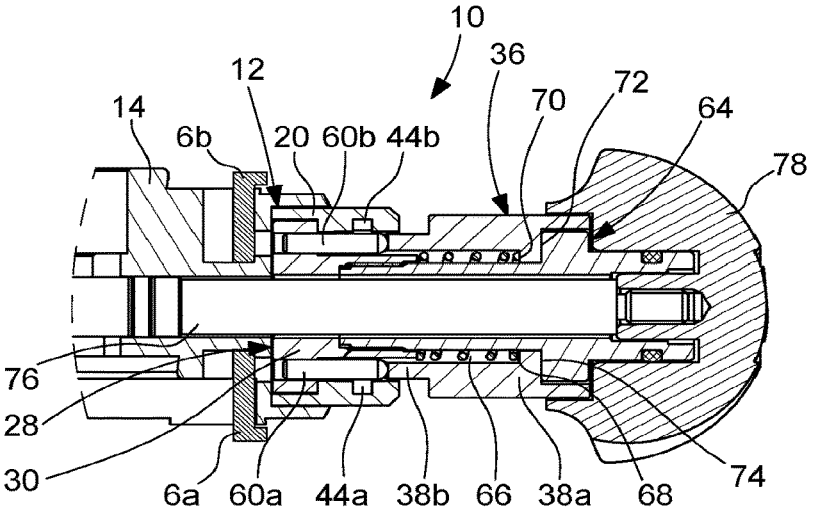
Figure 12:
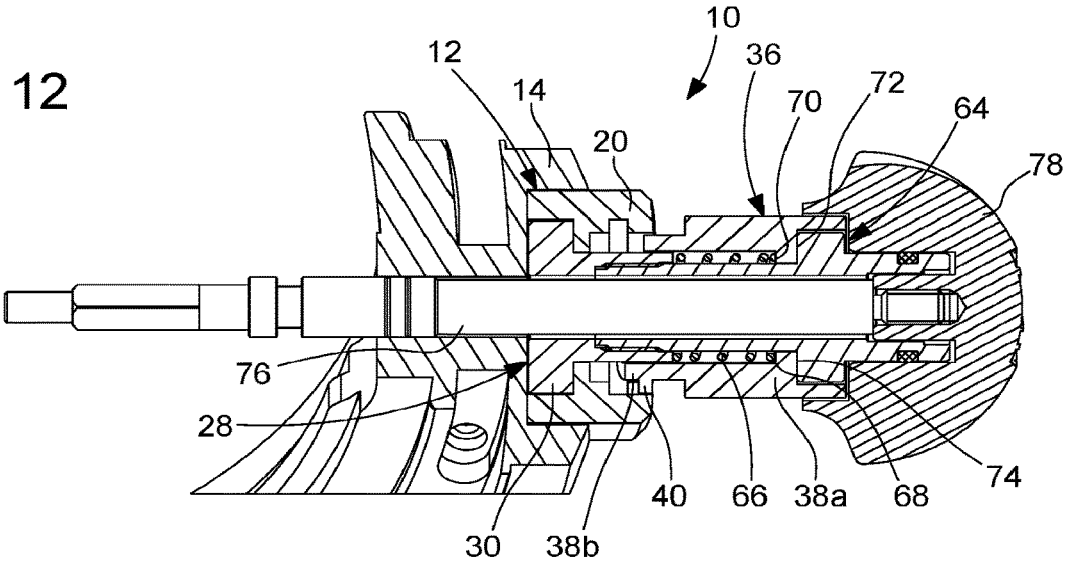
Figure 13:
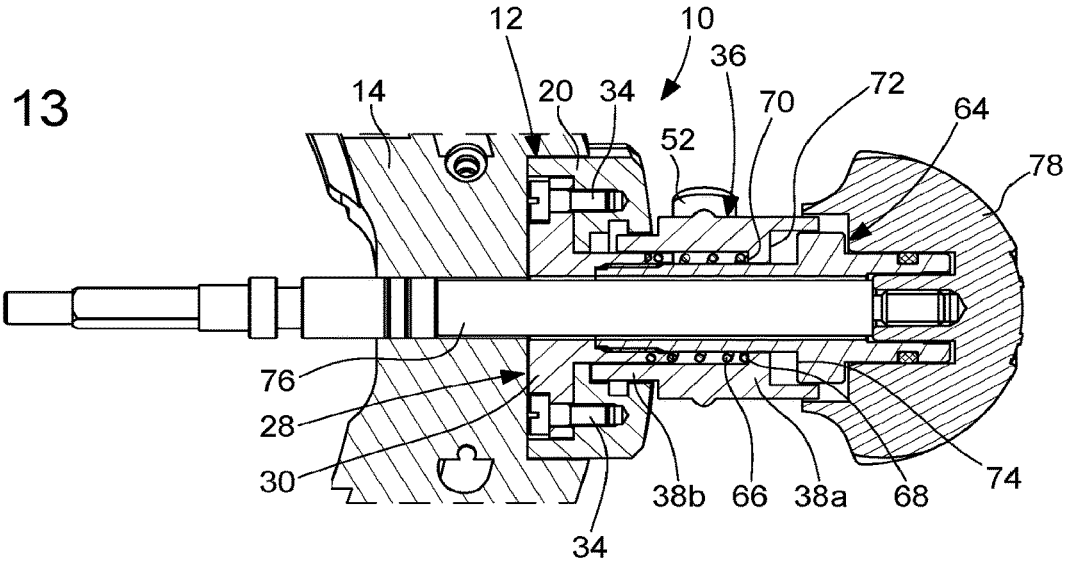
FIGS. 13, 14 and 15 are sectional views similar to those in FIGS. 10, 11 and 12, whereby the device for opening the covers has been axially pushed in towards the centre of the watch case.
Figure 14:
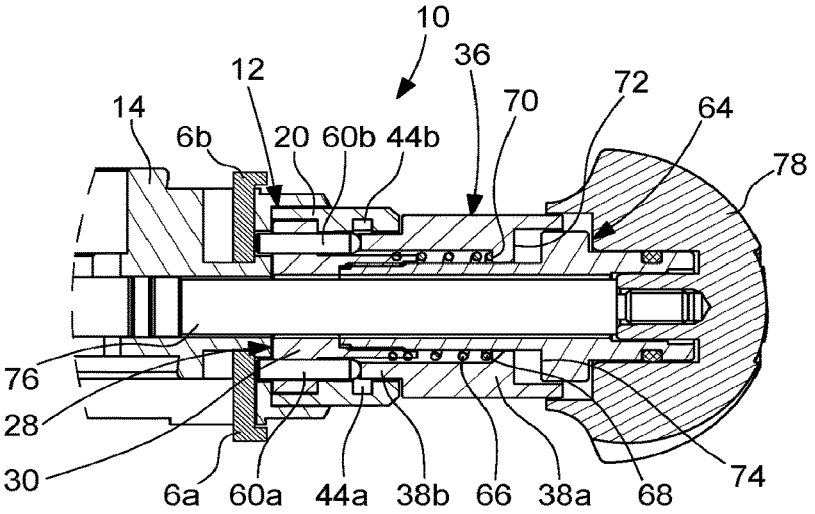
Figure 15:
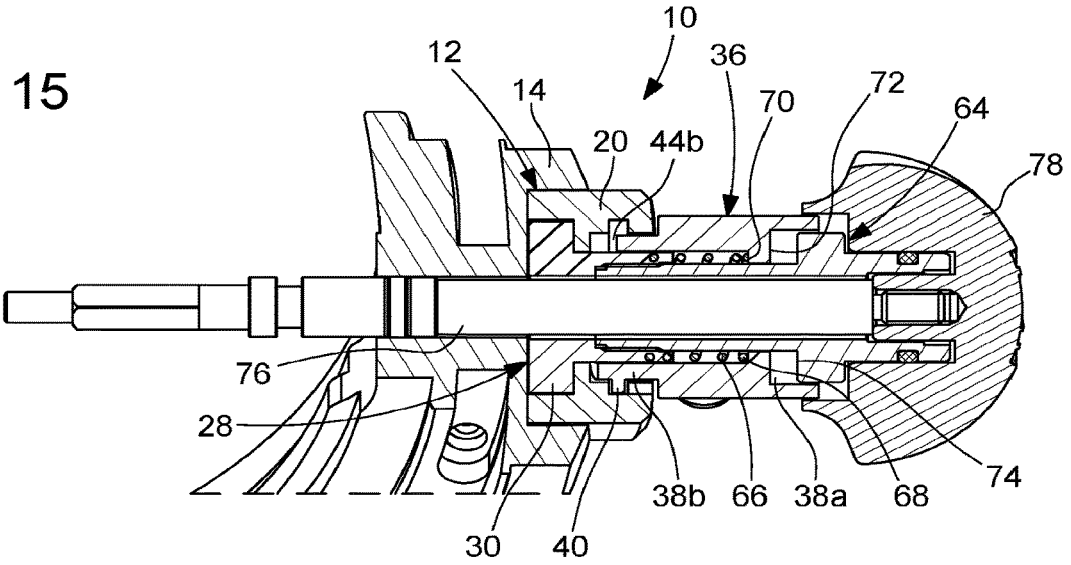
Figure 16:
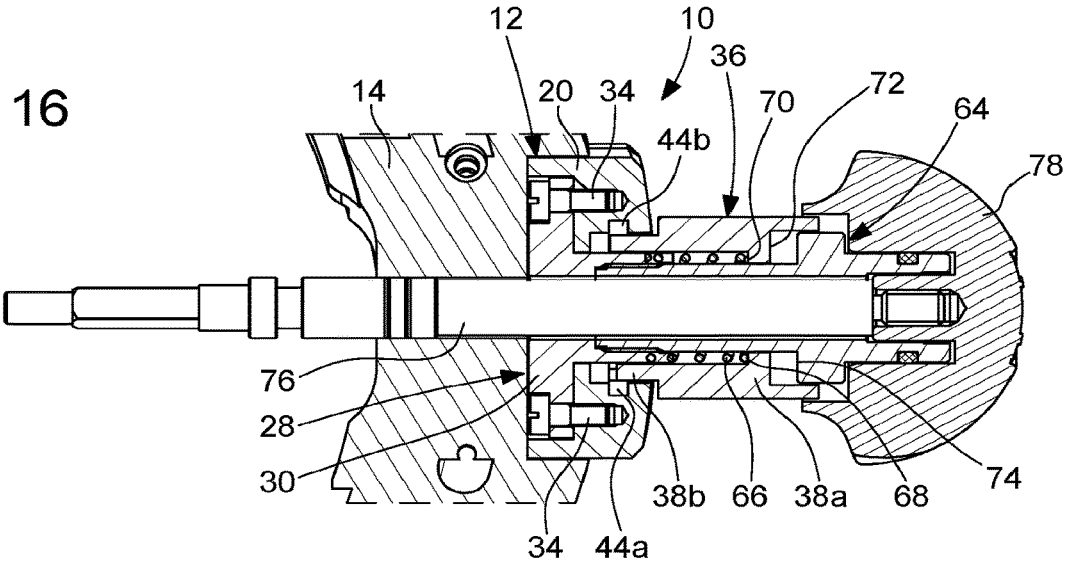
FIGS. 16, 17 and 18 are views similar to those in FIGS. 13, 14 and 15, whereby the device for opening the covers has been rotated clockwise from the pushed-in position thereof.
Figure 17:
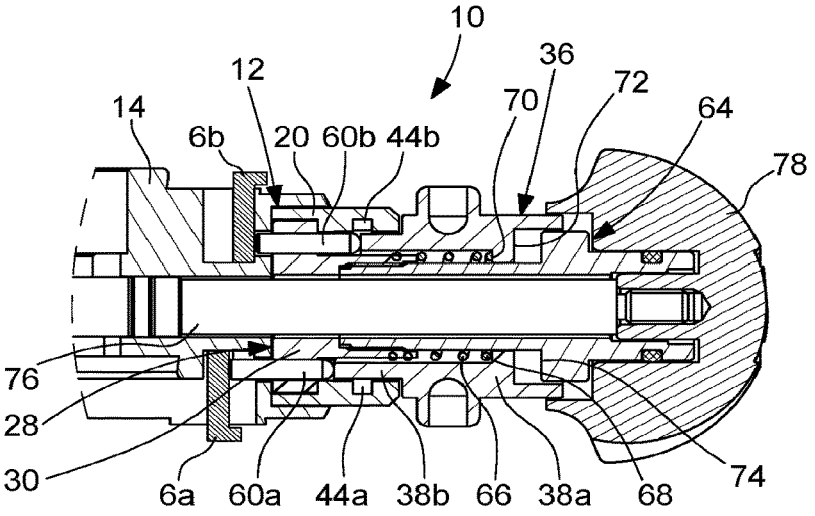
Figure 18:
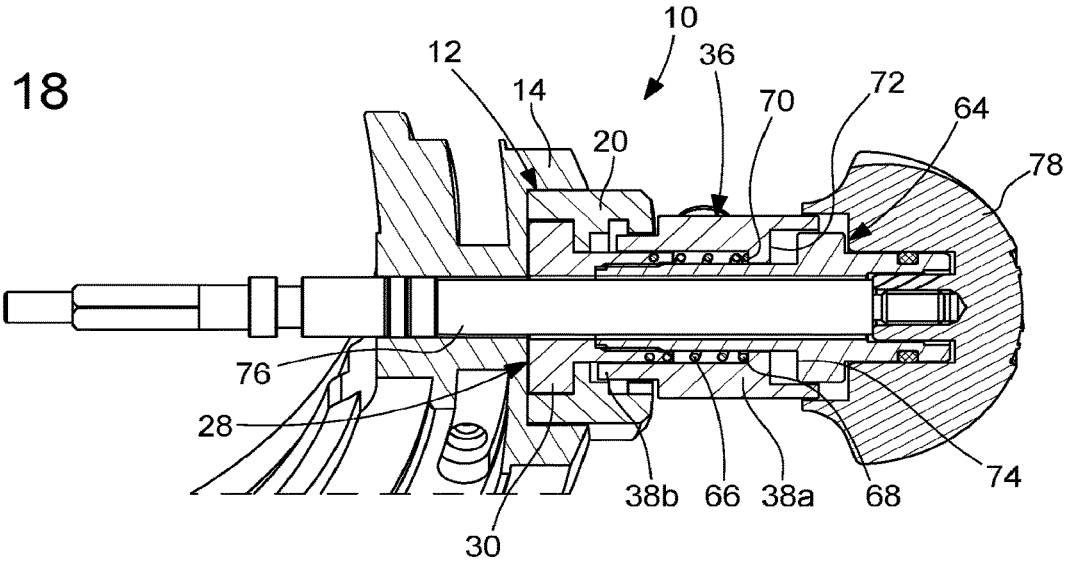
Figure 19:
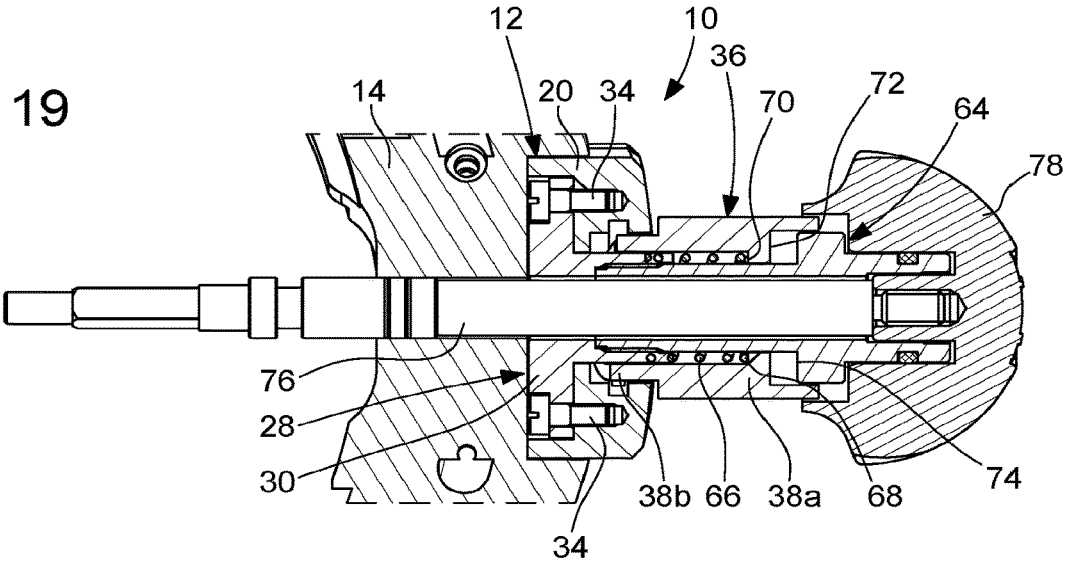
FIGS. 19, 20 and 21 are views similar to those in FIGS. 13, 14 and 15, whereby the device for opening the covers has been rotated anticlockwise from the pushed-in position thereof.
Figure 20:
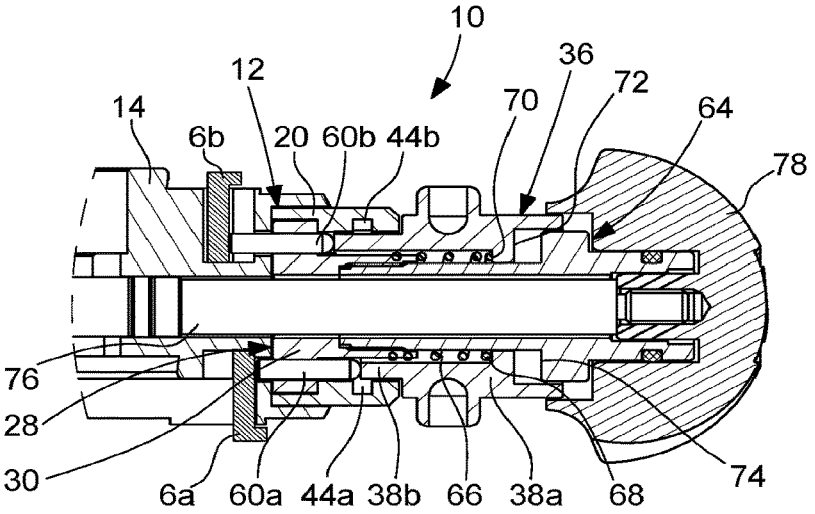
Figure 21:
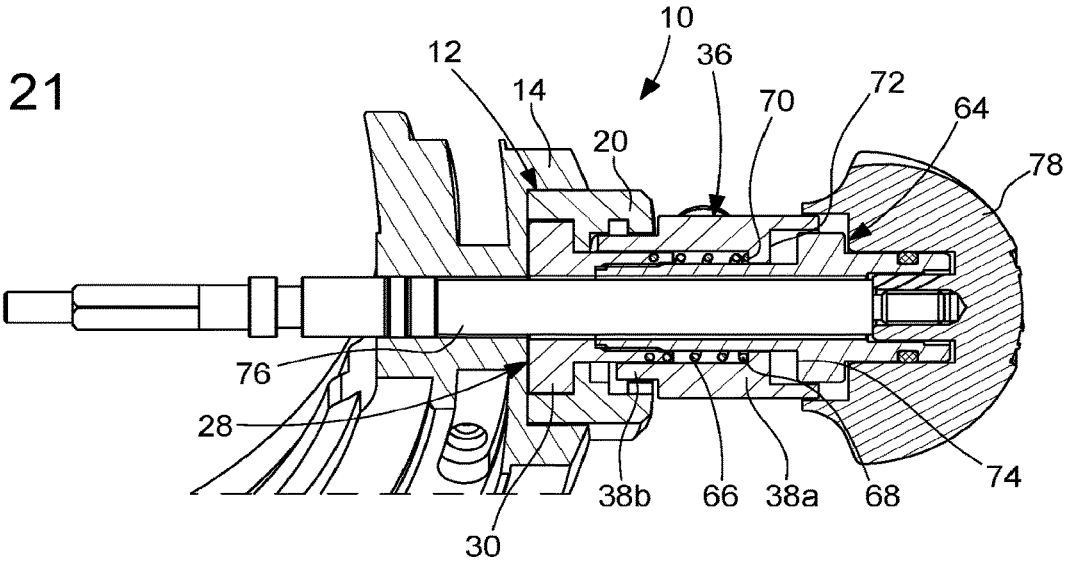
Figure 22:
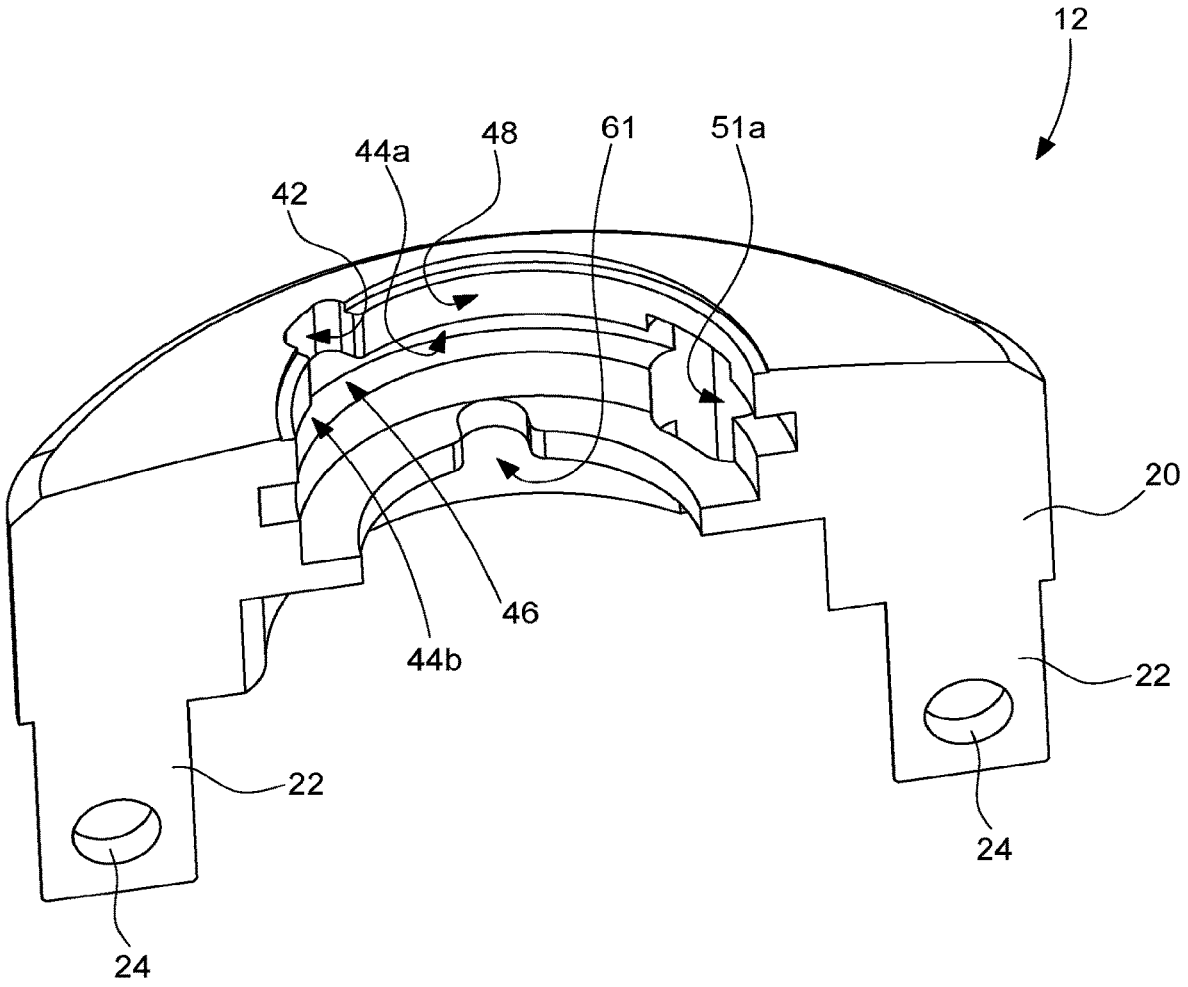
FIG. 22 is a perspective view with partial cutaway of the movable pendant in which the axial guide groove that opens out into one of the circumferential guide grooves can be seen.

The present invention was born from the general inventive idea of equipping a timepiece, in particular a pocket watch, with a device for opening at least one cover covering a display device. The opening device that equips the timepiece according to the invention makes use of a limited number of parts, such that the operation thereof is very reliable. Moreover, in order to be able to open the cover of the timepiece, in particular of the pocket watch, the owner thereof must carry out a manoeuvre which, while being intuitive and easy to remember, makes it almost impossible for the cover to accidentally open.

The term "proximal" must be understood in the present patent application to describe that which is situated on the watch case side, and the term "distal" must be understood herein to describe that which is situated on the crown side of the watch. Moreover, the term "axial" will denote any element that extends towards the centre of the watch case, and the term "radial" will apply to an element that extends in an arc of a circle centred about an axial direction.

Denoted as a whole by the general reference numeral 1, the pocket watch shown in the figures accompanying the present patent application illustrates a specific embodiment of a timepiece according to the invention. However, it must be understood that the invention is not limited to such a pocket watch 1 and that it can be applied to any other type of timepiece, in particular a wristwatch. It must also be understood that, in the simplified embodiment thereof, the present invention can be applied to a timepiece such as a pocket watch comprising a single cover. However, the description given below refers to the case of a pocket watch 1 comprising a first cover 2*a* on a front face 4*a* and a second cover 2*b* on a rear face 4*b*. These first and second covers 2*a* and 2*b* are capable of moving between a closed position in which they cover a device for displaying a piece of information, for example time information, or even a decorative pattern, and protect these display devices or these decorative patterns from any external attack, and an open position in which they reveal these display devices or these decorative patterns to the owner of the watch.

The pocket watch 1 according to the invention further comprises a first and a second locking spring 6*a* and 6*b* which respectively allow the first and second covers 2*a* and 2*b* to be held in the closed position. In a preferred alternative but non-limiting embodiment, the pocket watch 1 further comprises a first and a second unlocking spring 8*a* and 8*b* which ease the movement opening the first and second covers 2*a* and 2*b* respectively.

As stated hereinabove, the purpose of the present invention is to provide a timepiece such as a pocket watch equipped with a device allowing the one or more covers of this pocket watch to be opened in a simple and secure manner, while making any accidental opening of these covers virtually impossible.

For this purpose, the pocket watch 1 in accordance with the invention comprises a device 10 allowing the owner thereof to selectively and reliably open the first or the second cover 2*a*, 2*b*. This opening device 10 firstly comprises a fixed pendant 12 mounted in a middle part 14 which delimits a watch case 16 inside the internal volume of which a horological movement 18 is in particular housed. In a non-limiting manner, this fixed pendant 12 takes on the form of a body 20 having an overall cylindrical shape, the central axis of symmetry thereof extending towards a centre O of the watch case 16. Advantageously, the fixed pendant 12 is extended on the proximal side thereof by at least one, and preferably two feet 22, each of which is perforated by a hole 24 for the passage of two screws for mounting the fixed pendant 12 onto the middle part 14 of the pocket watch 1.

It must be understood that, although in the example described here, the central axis of symmetry of the body 20 extends towards the centre O of the watch case 16, by means of a few adaptations within the capabilities of a person skilled in the art, this central axis of symmetry can be given a different orientation.

The opening device 10 of the pocket watch 1 further comprises, in a preferred but non-exclusive manner, a pendant pipe 28 mounted such that it is fixed inside the middle part 14 of the pocket watch 1, coaxially inside the fixed pendant 12. This pendant pipe 28 comprises, for example, a flange 30 perforated by one or by two holes 32 for the passage of two screws 34 for fastening the pendant pipe 28 in a removable manner in the fixed pendant 12 which, for this purpose, is provided with two threaded holes 35 for receiving the screws 34.

The opening device 10 of the pocket watch 1 is completed by a movable pendant 36 capable of sliding coaxially within the fixed pendant 12, between same and the pendant pipe 28, towards the centre O of the watch case 16, then of being pivoted. In accordance with the invention, this movable pendant 36 takes on the form of a succession of two cylindrical pipe portions 38*a* and 38*b* which extend from the distal side towards the proximal side, the second cylindrical pipe portion 38*b* having a diameter that is less than that of the first cylindrical portion 38*a*.

More specifically, the second cylindrical pipe portion 38*b* is equipped, on the outside surface thereof, with a guide element 40, such as a catch capable of being displaced along an axial guide groove 42, then in either one of two circumferential guide grooves 44*a* and 44*b* which extend along either side of the axial guide groove 42 from a proximal end 46 of this axial guide groove 42. As shown in the figures, the axial guide groove 42 and the circumferential guide grooves 44*a*, 44*b* are made in an inside surface 48 of the fixed pendant 12, the circumferential guide grooves 44*a*, 44*b* being equipped with a boundary 50*a*, 50*b* away from the place at which the axial guide groove 42 opens out. Thus, when the movable pendant 36 is pushed towards the centre O of the watch case 16, this movable pendant 36 can be firstly displaced axially, then pivoted clockwise or anticlockwise by an angle defined by the place at which the guide element 40 abuts against the boundary 50*a* or 50*b* which delimits the corresponding circumferential guide groove 44*a* or 44*b*.

For the purposes of illustration only, the boundaries 50*a*, 50*b* are formed by two pillars which are fastened to the flange 30 of the pendant pipe 28 or which are made in one piece with this flange 30. When the fixed pendant 12 is assembled with the pendant pipe 28, the two pillars pass through respective openings 51*a*, 51*b* made in the bottom of the fixed pipe 12 and which open out into the circumferential guide grooves 44*a*, 44*b*. Preferentially, the angle between the place at which the axial guide groove 42 opens out into the circumferential guide grooves 44*a*, 44*b* and the place at which the pillars delimit these circumferential guide grooves 44*a*, 44*b* is equal or substantially equal to 90°.

As shown in the figures, the first cylindrical pipe portion 38*a* is provided with a means 52 for fastening a maneuvering ring 54 of the opening device 10. This maneuvering ring 54 is optional and can be replaced by another actuating member.

The second cylindrical pipe portion 38*b* has, at the base 56 thereof, on the proximal side, a first and a second helical groove 58*a* and 58*b* which form a cam path. These first and second helical grooves 58*a* and 58*b*, each of which extends over 90°, rise from the base 56 of the second cylindrical pipe portion 38*b* towards the centre O of the watch case 16 and converge towards one another as far as an apex S, where they join. As will be described in more detail hereinbelow, the purpose of these first and second helical grooves 58*a* and 58*b* is to control the translation towards the centre O of the watch case 16 of a first, or respectively of a second pin 60*a*, 60*b*, which comes to press against the first, or respectively the second locking spring 6*a*, 6*b* and releases the corresponding cover 2*a*, 2*b* from the retaining force exerted thereon by the locking spring 6*a* or 6*b* concerned. The pins 60*a*, 60*b* are guided axially along aa clearance 61 made in the fixed pendant 12 and pass through two openings 62 provided in the flange 30 of the pendant pipe 28.

The opening device 10 of the pocket watch 1 further comprises a crown pipe 64 which is engaged coaxially inside the movable pendant 36 and which is fastened inside the pendant pipe 28, for example by screwing. In order to allow the movable pendant 36 to slide axially inside the fixed pendant 12, a return spring 66 is threaded onto the crown pipe 64. On the proximal end side thereof, the return spring 66 bears against the pendant pipe 28 whereas, on the distal end side thereof, the return spring 66 bears against a first shoulder 68 defined by an inner diameter narrowing 70 of the movable pendant 36, this inner diameter narrowing 70 further defining a second shoulder 72 against which the crown pipe 64 comes to bear via an outer diameter increase 74. The journey made by the movable pendant 36 pushed towards the centre O of the watch case 16 is equal to about one millimetre. Similarly, the first and second pins 60*a*, 60*b* are axially free and the axial motion thereof is also equal to about one millimetre.

Finally, the opening device 10 comprises a setting stem 76 which is coaxially engaged inside the crown pipe 64 and the pendant pipe 28 and which, at a proximal end, penetrates the watch case 16 and engages with the horological movement 18. At the distal end thereof, the setting stem 76 is covered by a crown 78.

The working principle of the opening device 10 according to the invention is as follows. The movable pendant 36 is firstly pushed by the owner of the pocket watch 1 towards the centre O of the watch case 16 against the resilience of the return spring 66. During this movement, the guide element 40 slides inside the axial guide groove 42. When the guide element 40 abuts against the bottom of the axial guide groove 42, the owner can pivot the movable pendant 36 clockwise or anticlockwise such that the guide element 40 penetrates either one of the circumferential guide grooves 44*a* or 44*b*. It being assumed that the guide element 40 penetrates the first circumferential guide groove 44*a*, it is understood that, under the effect of the pivoting of the movable pendant 36, the first helical groove 58*a* will come into contact with the first pin 60*a* and gradually force same to move axially towards the centre O of the watch case 16. When the movable pendant 36 has been rotated 90° in the clockwise direction relative to the position that it occupied when it was axially free, the guide element 40 abuts against the boundary 50*a* situated at the bottom of the circumferential guide groove 44*a* and the first helical groove 58*a* is in contact with the first pin 60*a* via the apex S thereof. In this position, the first pin 60*a* is pushed forwards as far as possible towards the centre O of the watch case 16 and presses against the first locking spring 6*a* so as to release the first cover 2*a* from the action of this locking spring 6*a* and allow for the opening thereof. In a preferred but non-limiting manner, the opening of the first cover 2*a* can be assisted by the first unlocking spring 8*a*. The opening of the second cover 2*b* is obtained in the same way as the opening of the first cover 2*a*, with the exception that the owner rotates the movable pendant 36 in the anticlockwise direction so as to slide the guide element 40 into the second circumferential guide groove 44*b*, which will cause the second cover 2*b* to open.

After opening the first cover 2*a*, the movable pendant 36 is pivoted so as to remove the guide element 40 from the circumferential guide groove 44*a* in which it is located and to bring it to the foot of the axial guide groove 42. After having reached this point, the movable pendant 36 is brought back into the distal position thereof under the effect of the resilience of the return spring 66 which expands. After viewing his/her pocket watch 1, the owner can manually close the first cover 2*a* by bringing same into its position in which it is engaged with the first locking spring 6*a*.

It goes without saying that the present invention is not limited to the embodiment described above and that various simple alternatives and modifications can be considered by a person skilled in the art without leaving the scope of the invention as defined by the accompanying claims. In particular, it should be noted that, in the description given hereinabove, the present invention has been described with reference to a pocket watch 1 comprising a first cover 2*a* on the front face 4*a* thereof and a second cover 2*b* on the rear face 4*b* thereof. For this purpose, the opening device 10 comprises a first and a second helical groove 58*a*, 58*b*, in addition to a first and a second pin 60*a*, 60*b*. However, it is understood that this example design is provided as a non-limiting example and that the pocket watch 1 according to the invention can comprise only one cover 2*a*, whose opening will be controlled by a single helical groove 58*a* and a single pin 60*a*.

REFERENCES

1. Pocket watch
2*a*, 2*b*. First and second covers
4*a*, 4*b*. Front face and rear face
6*a*, 6*b*. First and second locking springs
8*a*, 8*b*. First and second unlocking springs
10. Opening device
12. Fixed pendant
14. Middle part
16. Watch case
18. Horological movement
20. Body
O. Centre of the watch case
22. Feet
24. Holes
28. Pendant pipe
30. Flange
32. Holes
34. Screws
35. Threaded holes
36. Movable pendant
38*a*, 38*b*. First and second cylindrical pipe portions
40. Guide element
42. Axial guide groove
44*a*, 44*b*. Circumferential guide grooves
46. Proximal end
48. Inside surface
50*a*, 50*b*. Boundary
51*a*, 51*b*. Openings
52. Fastening means
54. Maneuvering ring
56. Base
58*a*, 58*b*. First and second helical grooves S. Apex
60*a*, 60*b*. First and second pins
61. Clearances
62. Openings
64. Crown pipe
66. Return spring
68. First shoulder
70. Inner diameter narrowing
72. Second shoulder
74. Outer diameter increase
76. Setting stem
78. Crown

The invention claimed is:

1. A timepiece, comprising a case delimited by a middle part and at a centre of which a horological movement is housed, the timepiece further comprising, on at least one of front or rear faces thereof, a cover covering a device for displaying a piece of information or a decorative pattern, the timepiece further comprising a device for opening the cover, said cover being held in the closed position by a locking spring, the opening device comprising a fixed pendant mounted inside the middle part of the timepiece, in addition to a movable pendant capable of sliding coaxially within the fixed pendant towards the centre of the case, the movable pendant being equipped with a guide element capable of moving along an axial guide groove, then in a circumferential guide groove into which the axial guide groove opens out, the axial guide groove and the circumferential guide groove being made in an inside surface of the fixed pendant, the circumferential guide groove being provided with a boundary away from the place at which the axial guide groove opens out, such that, when the movable pendant is pushed towards the centre of the case, said movable pendant can be firstly displaced axially, then pivoted by an angle defined by the place at which the guide element abuts against the boundary which delimits the circumferential guide groove, the opening device further comprising at least one pin which extends axially towards the centre of the case and which is arranged with a clearance between the movable pendant and the locking spring, the movable pendant having, on the side of the pin, a helical groove, said helical groove coming into contact with the pin and causing the axial displacement thereof towards the locking spring when the movable pendant is pushed, then pivoted, such that the pin presses against the locking spring and releases the cover from the retaining force exerted thereon by the locking spring.

2. The timepiece according to claim 1, wherein the angle between the place at which the axial guide groove opens out into the circumferential guide groove and the place at which the boundary delimits the circumferential guide groove is equal or substantially equal to 90°.

3. The timepiece according to claim 1, wherein the opening device comprises a pendant pipe mounted such that it the pendant pipe is fixed inside the middle part of the timepiece, coaxially inside the fixed pendant, the movable pendant being capable of sliding between the fixed pendant and the pendant pipe.

4. The timepiece according to claim 2, wherein the opening device comprises a pendant pipe mounted such that it the pendant pipe is fixed inside the middle part of the timepiece, coaxially inside the fixed pendant, the movable pendant being capable of sliding between the fixed pendant and the pendant pipe.

5. The timepiece according to claim 3, wherein the opening device comprises a return spring disposed coaxially inside the movable pendant and bearing between the movable pendant and the pendant pipe.

6. The timepiece according to claim 4, wherein the opening device comprises a return spring disposed coaxially inside the movable pendant and bearing between the movable pendant and the pendant pipe.

7. The timepiece according to claim 5, wherein the opening device further comprises a crown pipe arranged coaxially inside the movable pendant and on which the return spring is threaded, said crown pipe being fixed inside the pendant pipe.

8. The timepiece according to claim 6, wherein the opening device further comprises a crown pipe arranged coaxially inside the movable pendant and on which the return spring is threaded, said crown pipe being fixed inside the pendant pipe.

9. The timepiece according to claim 7, wherein the opening device comprises a maneuvering ring mounted on the movable pendant.

10. The timepiece according to claim 7, wherein the opening device comprises a setting stem which is disposed coaxially inside the crown pipe and which is guided by the pendant pipe.

11. The timepiece according to claim 8, wherein the opening device comprises a setting stem which is disposed coaxially inside the crown pipe and which is guided by the pendant pipe.

12. The timepiece according to claim 9, wherein the opening device comprises a setting stem which is disposed coaxially inside the crown pipe and which is guided by the pendant pipe.

13. The timepiece according to claim 10, wherein the opening device comprises a crown mounted such that it is fixed on the setting stem.

14. The timepiece according to claim 1, comprising a first cover over the front face and a second cover over the rear face, the first cover being held in the closed position by a first locking spring, whereas the second cover is held in the closed position by a second locking spring, the axial guide groove opening out into both of two circumferential guide grooves which extend on either side of said axial guide groove and which are both delimited by a boundary, such that, when the movable pendant is pushed towards the centre of the case, said movable pendant can first be displaced axially, then be pivoted to the left or to the right by an angle defined by the place at which the guide element abuts against the boundary that delimits the circumferential guide groove in which it is located, the opening device comprising a first and a second pin which extend axially towards the centre of the case and which are arranged with a clearance between the movable pendant and the first locking spring, respectively the second locking spring, the movable pendant having, on the side of the first and second pin, a first and a second helical groove, said first and second helical grooves being arranged such that, depending on the direction in which the movable pendant is pivoted after having been pushed, either the first helical groove comes into contact with the first pin, or the second helical groove comes into contact with the second pin and causes, depending on the case, the axial displacement of the first pin or of the second pin towards the first locking spring, or respectively the second locking spring, such that, either the first pin presses against the first locking spring and releases the first cover from the retaining force exerted thereon by the first locking spring, or the second pin presses against the second locking spring and releases the second cover from the retaining force exerted thereon by the second locking spring.

* * * * *